US008587487B2

(12) United States Patent
Kuehne et al.

(10) Patent No.: US 8,587,487 B2
(45) Date of Patent: Nov. 19, 2013

(54) ANTENNA ARRANGEMENT AND METHOD

(75) Inventors: Rainer Kuehne, Hannover (DE); Michael Thole, Hildesheim (DE); Urs Natzschka, Hannover (DE)

(73) Assignee: Blaupunkt Antenna Systems GmbH & Co., Hildesheim (DE)

( * ) Notice: Subject to any disclaimer, the term of this patent is extended or adjusted under 35 U.S.C. 154(b) by 496 days.

(21) Appl. No.: 12/745,056

(22) PCT Filed: Oct. 1, 2008

(86) PCT No.: PCT/EP2008/063115

§ 371 (c)(1),
(2), (4) Date: Sep. 3, 2010

(87) PCT Pub. No.: WO2009/068350

PCT Pub. Date: Jun. 4, 2009

(65) Prior Publication Data

US 2010/0328170 A1 Dec. 30, 2010

(30) Foreign Application Priority Data

Nov. 30, 2007 (DE) ..... 10 2007 057 714

(51) Int. Cl.
*H01Q 1/32* (2006.01)

(52) U.S. Cl.
USPC ..... 343/712; 343/711; 343/713

(58) Field of Classification Search
USPC ..... 343/712, 711, 713
See application file for complete search history.

(56) References Cited

U.S. PATENT DOCUMENTS

| | | | | |
|---|---|---|---|---|
| 4,954,797 | A | 9/1990 | Shinnai et al. | |
| 6,239,758 | B1 | 5/2001 | Fuchs et al. | |
| 6,307,516 | B1 | 10/2001 | Zafar et al. | |
| 6,400,334 | B1 * | 6/2002 | Lindenmeier et al. | 343/850 |
| 2006/0012532 | A1 * | 1/2006 | Baba et al. | 343/713 |
| 2006/0097936 | A1 * | 5/2006 | Bally et al. | 343/713 |
| 2009/0015492 | A1 * | 1/2009 | Kuehne | 343/704 |

FOREIGN PATENT DOCUMENTS

| | | |
|---|---|---|
| DE | 40 34 548 | 5/1992 |
| EP | 0 375 331 | 6/1990 |
| EP | 0 411 963 | 2/1991 |
| EP | 1 076 375 | 8/1999 |
| EP | 1 168 888 | 1/2002 |
| JP | 1 841 007 | 10/2007 |

OTHER PUBLICATIONS

International Search Report for PCT/EP2008/063115, dated Nov. 18, 2008.

* cited by examiner

*Primary Examiner* — Douglas W Owens
*Assistant Examiner* — Collin Dawkins
(74) *Attorney, Agent, or Firm* — Kenyon & Kenyon LLP

(57) ABSTRACT

In an antenna arrangement, particularly for a motor vehicle window pane antenna, a first conductor structure is provided, which is formed by the heating field of a window pane and a second conductor structure, which is configured as an antenna conductor structure and which is situated galvanically separated from the heating field. At least one conductor of the heating field runs in the form of loops between the actual heating field and an outer edge of the pane 2. The second conductor structure extends comb-like into the loops of this at least one conductor of the heating field.

13 Claims, 2 Drawing Sheets

ANTENNA ARRANGEMENT AND METHOD

FIELD OF THE INVENTION

The present invention is based on an antenna arrangement or a method.

BACKGROUND INFORMATION

An antenna arrangement is discussed in U.S. Pat. No. 6,307,516 B1, in which the heating field is used as an antenna for reception of UKW signals (FM signals). Between the upper edge of the motor vehicle window pane and the heating field there is a separate conductor structure, not galvanically connected to the heating field, as an antenna for reception of LMK signals (AM signals).

It is understood that there are also heating structures in which the complete heating field is used as an antenna for AM and FM signals, as discussed, for instance, in EP 1 076 375 A2.

SUMMARY OF THE INVENTION

Using the antenna arrangement and the method according to the exemplary embodiments and/or exemplary methods of the present invention, heating of the entire pane is possible and so is the accommodation of a separate antenna structure. Compared to U.S. Pat. No. 6,307,516 B1, the advantage comes about that, even in the area of the second conductor structure, the heating of the pane is possible, with only one heating circuit having to be provided. Compared to the structure of EP 1 076 375 A2, the conductor structure on the pane does not have to be decoupled at high frequency from the vehicle electrical system via antiresonance circuits, nor does a second heating circuit have to be provided. The integration of at least one antenna structure, which is galvanically decoupled from the heating field, is possible, in particular, in the case of small pane sizes. An additional advantage is the arrangement of the second conductor structure in the loops of a heating conductor without crossing. Because of this, one may do without costly contact bridges.

Because of the arrangement of the first and second conductor structure on the same side of the pane, all the structures may advantageously be applied using the same screen printing.

Even heating may advantageously be achieved by having the looped-shaped heating conductor designed, through variation in its width, in such a way that the resistance value is in each case the same, compared to the rest of the heating conductors.

It is advantageous at least to lay out the second conductor structure so that it couples capacitively with the first conductor structure. The heating conductor field may thereby also be used as an antenna structure without the costly AM antiresonance circuits being required. The first conductor structure may advantageously be used as an FM antenna structure, and the second conductor structure may be used as an AM antenna conductor structure, there being the possibility of designing the first conductor structure for FM diversity reception. In this context, the second conductor structure may also be used for the switching in at high frequency of an impedance network, for influencing the directional effect for the FM reception via the second conductor structure, which is coupled at high frequency to the first conductor structure. This saves separate contacting for the interface connections of this impedance network.

If one is actually going to do without coupling, at high frequency, to the heating field, the second conductor structure may be designed both for a frequency range of FM signals and AM signals. It is also possible to accommodate an additional conductor structure in an additional heating conductor that is designed in a loop-like form, if various frequency ranges are to be decoupled from one another, or if one wishes to have different alignments of the antenna structure for different polarizations.

Exemplary embodiments of the present invention are shown in the drawings and explained in greater detail in the following description.

DETAILED DESCRIPTION

Figure 1:
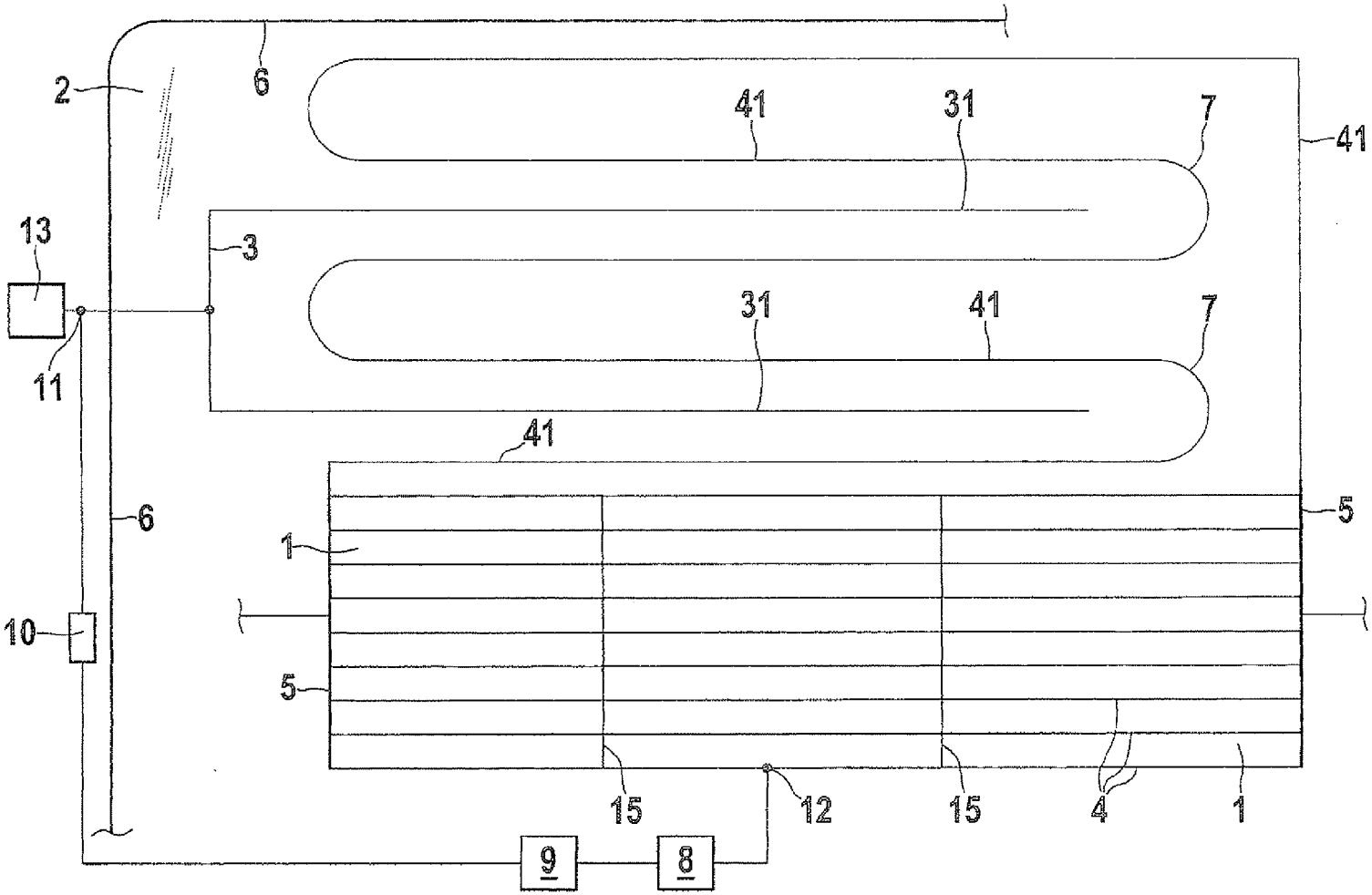
FIG. 1 shows a first antenna arrangement according to the present invention, having an antenna conductor structure that is configured essentially horizontally.

As shown in FIG. 1, the antenna arrangement according to the present invention is made up of a first conductor structure 1 on a window pane 2, which may be the rear window of a motor vehicle, as well as of a second conductor structure 3. Conductor structure 1 is formed by the heating field for heating window pane 2. The latter is made up of heating wires 4 running in parallel in the horizontal direction and vertical bus bars 5, into which the heating current is fed. At least one conductor 41 of the heating field runs in the form of loops between the actual heating field and outer edge 6 of pane 2, which is usually designed as a metallic frame. Loops 7 of conductor 41 run essentially in the horizontal direction and parallel to the actual heating wires 4. The upper end of loops 7 is guided, via a vertical conductor section, to the right bus bar. Second conductor structure 3 extends comb-like into loops 7 that are formed by conductor 41. Consequently, conductor structure 3 is separated galvanically from first conductor structure 1, and thus from the heating field. Therefore, there are no antiresonance circuits required for the decoupling at high frequency of conductor structure 3 from the vehicle electrical system. First conductor structure 1 and second conductor structure 3 may be able to be applied in the same screen printing and on the same side of the pane.

Conductor structure 3 may be designed both for a frequency range for the reception of AM signals, e.g. in the LMK range, and for the reception of FM signals, e.g. in the UKW range, for instance, by different lengths of fingers 31, which extend into loops 7. Alternatively to this, conductor structure 3 may be provided only for the reception of AM signals, and conductor structure 1 only for the reception of FM signals. In this case, at least one may do without a cost-intensive and weight-intensive AM antiresonance circuit for decoupling from the vehicle electrical system. When conductor structure 3 for reception of FM signals is designed, the heating field may also be used to receive FM signals, via a suitable capacitive coupling between at least one of fingers 31 and loops 7 of conductor 41. Then too, no vehicle electrical system decoupling is required. If the heating field is provided for reception of FM signals, a diversity operation may be implemented without considerable additional cost (additional high frequency contactings of the heating field). In the case of FM reception having interference, in base 12 of the FM antenna structure, an impedance network 10 is then connected to connecting point 11 of the second conductor structure, via a diversity evaluating device 9 associated with an FM receiving device 8. The directional effect during FM reception changes via the capacitance coupling of conductor 41 of the heating field to second conductor structure 3 and thus to impedance network 10, which makes possible again an undisturbed FM reception. AM reception device 13 is switched to ineffective in response to FM reception of connecting point 11.

Figure 2:
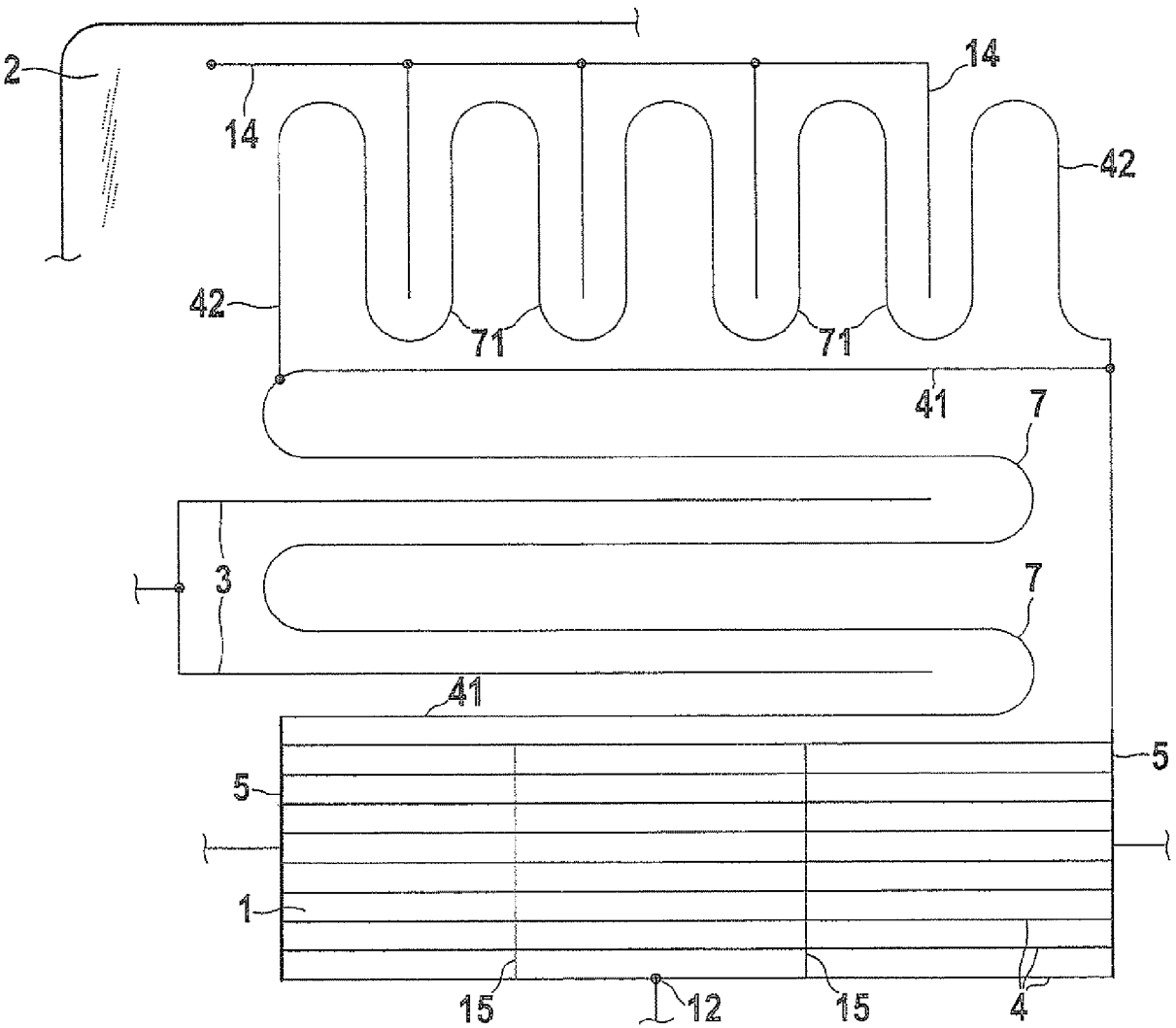
FIG. 2 shows an embodiment of the antenna arrangement according to the present invention, having horizontally and vertically configured antenna conductor structures.

FIG. 2 shows a further specific embodiment of the present invention. On the conductor section at the upper edge of pane 2, conductor 41 has a subcircuit in the form of conductor 42, which is also designed in the form of loops. Into these loops 71 of conductor 42, there extends, also comb-like, an additional conductor structure 14, which is designed for AM reception, for example, if second conductor structure 3 is designed for FM reception. In contrast to conductor structure 3, loops 71 of conductor 42 run in the vertical direction.

Additional conductor structure 14 may also be used or jointly used for another FM frequency range, for instance, for C2x (vehicle to vehicle communication or vehicle to infrastructure communication), by contrast to UKW radio reception or TV reception. Because of the different orientation of loops 7 and 71, and thus also of conductor structures 3 and 14, an improved separation is possible in the case of differently polarized send or receive signals. This different orientation of conductor structure 3 and 14 may also be used for diversity reception, that is, diversity evaluation device 9 switches over to that conductor loop 3 or 14 which supplies the best reception. This switching over may be combined with the switching on or off of impedance network 10, so that altogether four virtual FM antenna radiation patterns are created.

If pane 2 is to be heated uniformly, one should make sure that conductor 41 of FIG. 1 that runs loop-shaped, has the same resistance value, in spite of the elongation for forming the loops, as the remaining heating wires 4 of the heating field. This may be achieved most easily by varying its width compared to remaining heating wires 4, in such a way that a greater heating current is flowing through it, so as to achieve the same heating performance. This also has to be taken into account for the width of conductor 42, in FIG. 2, in the subcircuit of conductor 41.

The diversity effect is able to be improved by vertical conductors 15 in the heating field.

What is claimed is:

1. An antenna arrangement, comprising:

a first conductor structure, which is formed by a heating field of a window pane; and a second conductor structure, which is configured as an antenna conductor structure and which is situated so as to be galvanically separated from the heating field;

wherein at least one conductor of the heating field runs in a loop-like form between an actual heating field and an outer edge of the window pane, wherein the second conductor structure extends in a comb-like manner into loops formed by the at least one conductor of the heating field, and wherein the at least one conductor of the heating field, running in the form of loops, is configured by variation in its width so that its resistance value is the same as that of the other heating wires, notwithstanding its elongation because of its loop-like form.

2. The antenna arrangement of claim 1, wherein the second conductor structure is applied onto a same side of the window pane as the first conductor structure.

3. The antenna arrangement of claim 1, wherein the conductor structures were applied by a screen-printing technique.

4. The antenna arrangement of claim 1, wherein at least the second conductor structure is configured so as to couple capacitively at high frequency to the first conductor structure.

5. The antenna arrangement of claim 1, wherein the first conductor structure is configured for a frequency range of FM signals, and wherein the second conductor structure is configured for a frequency range of AM signals.

6. The antenna arrangement of claim 1, wherein the second conductor structure is configured both for a frequency range for reception of FM signals and for an additional frequency range, which is for reception of one of AM signals and further FM signals.

7. The antenna arrangement of claim 1, wherein the first conductor structure is configured for FM diversity reception.

8. The antenna arrangement of claim 1, wherein the antenna arrangement is for a motor vehicle window pane antenna.

9. The antenna arrangement of claim 4, wherein the second conductor structure is configured for connection at a high frequency of an impedance network, for influencing the directivity for the FM reception via the second conductor structure, which is coupled at a high frequency to the first conductor structure.

10. The antenna arrangement of claim 9, wherein the first conductor structure is used for a diversity operation, and wherein the second conductor structure is used for switching on at high frequency an impedance network at FM reception in case of interference.

11. A method for operating an antenna arrangement, which is for a motor vehicle window pane antenna, the method comprising:

picking off FM signals at a first conductor structure of the antenna arrangement; and picking off AM signals at a second conductor structure of the antenna arrangement;

wherein the antenna arrangement includes the first conductor structure, which is formed by a heating field of a window pane, and the second conductor structure, which is configured as an antenna conductor structure and which is situated so as to be galvanically separated from the heating field, wherein at least one conductor of the heating field runs in a loop-like form between an actual heating field and an outer edge of the window pane, and wherein the second conductor structure extends in a comb-like manner into loops formed by the at least one conductor of the heating field, and wherein the at least one conductor of the heating field, running in the form of loops, is configured by variation in its width so that its resistance value is the same as that of the other heating wires, notwithstanding its elongation because of its loop-like form.

12. A method for operating a conductor structure of an antenna arrangement, which is for a motor vehicle window pane antenna, the conductor structure including a first conductor structure and a second conductor structure, the method comprising:

picking off FM signals and AM signals at the second conductor structure;

wherein the antenna arrangement includes the first conductor structure, which is formed by a heating field of a window pane, and the second conductor structure, which is configured as an antenna conductor structure and which is situated so as to be galvanically separated from the heating field, wherein at least one conductor of the heating field runs in a loop-like form between an actual heating field and an outer edge of the window pane, and wherein the second conductor structure extends in a comb-like manner into loops formed by the at least one conductor of the heating field, and wherein the at least one conductor of the heating field, running in the form of loops, is configured by variation in its width so that its resistance value is the same as that of the other heating wires, notwithstanding its elongation because of its loop-like form.

13. The method of claim 12, wherein the first conductor structure is configured for a frequency range of FM signals, and wherein the second conductor structure is configured for a frequency range of AM signals.

* * * * *

UNITED STATES PATENT AND TRADEMARK OFFICE

CERTIFICATE OF CORRECTION

PATENT NO. : 8,587,487 B2
APPLICATION NO. : 12/745056
DATED : November 19, 2013
INVENTOR(S) : Kuehne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 590 days.

Signed and Sealed this
Twenty-second Day of September, 2015

Michelle K. Lee

Michelle K. Lee
*Director of the United States Patent and Trademark Office*